US005933390A

United States Patent [19]

Rosner et al.

[11] Patent Number: 5,933,390

[45] Date of Patent: Aug. 3, 1999

[54] METHOD FOR REDUCING THE ACCUMULATION OF PRECIPITANTS AND IMPURITIES ON ULTRASONIC TRANSDUCERS

[75] Inventors: Zeev Rosner, Kibbutz Netzer Sereni; Alex Riftin, Ashdod; Yacov Shoham, Kibbutz Netzer Sereni; Eli Gorenstein, Savyon, all of Israel

[73] Assignee: Green Clouds Ltd., Savyon, Israel

[21] Appl. No.: 08/908,592

[22] Filed: Aug. 8, 1997

[51] Int. Cl.[6] ..... F24F 3/14

[52] U.S. Cl. ..... 367/151

[58] Field of Search ..... 367/151, 908; 73/290 V; 62/247

[56] References Cited

U.S. PATENT DOCUMENTS 4,612,777 9/1986 Noma et al. ..... 62/247

5,038,611 8/1991 Weldon et al. ..... 73/290 V

*Primary Examiner*—Daniel T. Pihulic

*Attorney, Agent, or Firm*—Lowe Hauptman Gopstein Gilman & Berner

[57] ABSTRACT

A method for reducing the accumulation of impurities on the vibrating surface of an ultrasonic transducer includes the steps of immersing the transducer in a liquid and orienting the vibrating surface of the transducer at an oblique angle to the liquid surface. At least one immersed acoustic mirror is oriented opposite the vibrating surface such that the ultrasonic waves originating at the transducer vibrating surface are reflected by the mirror and directed to the liquid surface at a predetermined angle.

6 Claims, 1 Drawing Sheet

METHOD FOR REDUCING THE ACCUMULATION OF PRECIPITANTS AND IMPURITIES ON ULTRASONIC TRANSDUCERS

FIELD OF THE INVENTION

The present invention generally relates to a method for reducing the accumulation of precipatants and impurities on ultrasonic transducers. More specifically, the present invention relates to a system comprised of orienting the vibrating surface of a liquid immersed transducer at an oblique angle to the liquid surface, and placing and orienting at least one immersed acoustic mirror opposite the vibrating surface. The ultrasonic waves originating at the vibrating surface of the transducer are reflected by the acoustic mirror and directed to the liquid's surface at the required angle.

BACKGROUND OF THE INVENTION

Liquid immersed ultrasonic transducers are commonly used for the atomization of the surrounding liquid. According to the construction of most such devices, the transducer is oriented with the vibrating surface (the surface producing the ultrasonic waves) directed upward. The upward directed ultrasonic waves propagate until their energy is transferred (as momentum) to the surface layer.

Because the vibrating surface of the transducer is horizontal and upward directed, impurities and precipatates in the liquid tend to settle on the transducer's vibrating surface. This creates a thermal insulation layer on the vibrating surface which progressively degrades transducer performance. Furthermore, the degree of thermal insulation provided by this progressive layering (coating) becomes sufficient to force the transducer to self-destruct from overheating.

Impurities in liquids have many sources. Impurities may be initially present in the liquid. Impurities may enter into the liquid because of the liquid contact with the air. Sometimes impurities may be produced from interactions between the transducer (or the ultrasonic waves produced thereby) and the liquid, or may be produced by interactions between the liquid and other components of the device (e.g. electric currents, pump mechanisms, etc.). Furthermore, impurities may aggregate.

Methods for removal of impurities and precipatants only partially alleviate this problem, because the efficient removal of the ultra-fine particles of impurities and precipatants is often an unreasonably expensive process.

The present invention presents a simple and cost effective method for partially (or completely) alleviating this precipatant and impurity settlement problem. Transducer efficiency losses associated with the present method are of low order.

SUMMARY OF THE INVENTION

The present invention relates to a method for reducing the accumulation of precipatants and impurities on ultrasonic transducers. This method is comprised of orienting the vibrating surface of a liquid immersed transducer at an oblique angle to the liquid's surface, and placing and orienting at least one immersed acoustic mirror opposite the vibrating surface, such that the ultrasonic waves originating at the vibrating surface of the transducer are reflected by the acoustic mirror and directed to the liquid's surface at the required angle.

DETAILED DESCRIPTION OF THE INVENTION

The present invention relates to a method for reducing the accumulation of precipatants and impurities on the vibrating surface of ultrasonic transducers. The present method is comprised of orienting the vibrating (ultrasonic wave producing) surface of a liquid immersed transducer at an oblique angle to the liquid's surface, and placing and orienting at least one immersed acoustic mirror opposite the vibrating surface such that the ultrasonic waves originating at the vibrating surface of the transducer are reflected by the acoustic mirror and directed to the liquid's surface. The oblique angle between the vibrating surface of the transducer and the liquid's surface is from greater than zero degrees to less than 180 degrees, thereby never parallel to the liquid's surface.

According to one embodiment of the present method, the vibrating surface of the transducer is oriented skew to the liquid's surface (at an angle from less than 90 degrees to almost zero degrees (almost directly upward)). While impurities may settle onto the vibrating surface of the transducer, the settled impurities tend to slide off the inclined surface (and this sliding process is accelerated by the ultrasonic vibration of the vibrating surface).

According to another embodiment of the present method, the vibrating surface of the transducer is oriented about perpendicular to the liquid's surface, such that the emitted ultrasonic waves propagate parallel to the liquid surface. This eliminates the accumulation of floating or settling impurities on the vibrating surface of the transducer, since the vibrating surface stands about vertical. Accordingly the associated acoustic mirror (if flat) is oriented at an angle of about 45 degrees with respect to the liquid surface.

According to a third embodiment of the present method, the vibrating surface of the transducer is directing ultrasonic waves away from the liquid's surface (downwards—being at angles from greater than 90 degrees to less than about 180 degrees). This embodiment eliminates all possibility of settling impurities (such as precipatants) accumulating on the vibrating surface of the transducer. However there may be an equivalent accumulation of impurities on the acoustic mirror, but this will not lead to the mirror's destruction.

The present invention will be further described by FIGS. 1–3. These figures are solely intended to illustrate the preferred embodiment of the invention and are not intended to limit the scope of the invention in any manner.

DETAILED DESCRIPTION OF THE INVENTION

Figure 1:
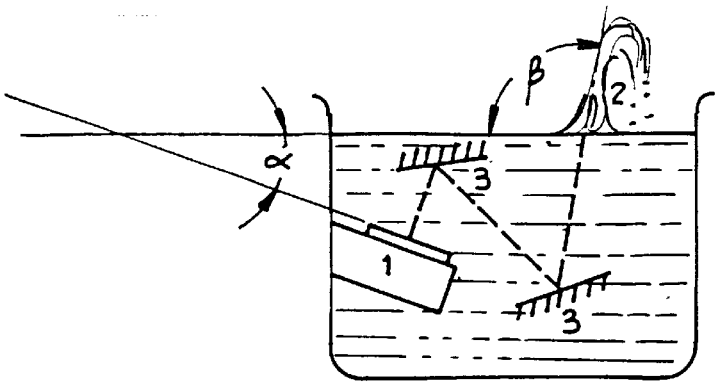
FIG. 1 illustrates a profile view of a device where the vibrating surface of the transducer is oriented skew to the liquid's surface.

FIG. 1 illustrates a profile view of a device where the vibrating surface of the transducer is oriented skew to the liquid's surface. Shown here is a device using the method for reducing the accumulation of precipatants and impurities on ultrasonic transducers according to the present invention.

An immersed ultrasonic transducer (1) in a liquid (4) is oriented with the vibrating surface of the transducer at an oblique angle $\alpha$ to the liquid's surface. Two immersed acoustic mirrors (3) (3') are positioned and oriented opposite the vibrating surface such that the ultrasonic waves originating at the vibrating surface of the transducer are reflected by the acoustic mirrors and directed to the liquid's surface at an approximately right angle β. This produces a spout shaped distribution containing a plurality of droplets (2) wherein the smaller droplets continue in an airborn trajectory while the larger droplets fall back onto the surface of the liquid.

Figure 2:
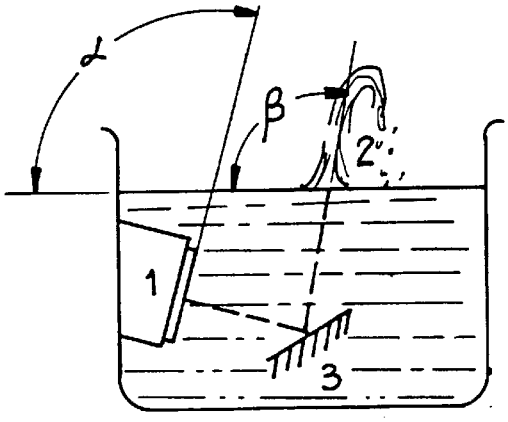
FIG. 2 illustrates a profile view of a device where the vibrating surface of the transducer is oriented about perpendicular to the liquid's surface.

FIG. 2 illustrates a profile view of a device wherein the vibrating surface of the transducer is oriented about perpendicular to the liquid surface. Shown here is a device using the method for reducing the accumulation of precipatants and impurities on ultrasonic transducers according to the present invention.

An immersed ultrasonic transducer (1) in a liquid (4) is oriented with the vibrating surface of the transducer at an oblique angle α to the liquid surface. An immersed acoustic mirror (3) is positioned and oriented opposite the vibrating surface such that the ultrasonic waves originating at the vibrating surface of the transducer are reflected by the acoustic mirror and directed to the liquid's surface at an approximately right angle β. This produces a spout shaped distribution containing a plurality of droplets (2) wherein the smaller droplets continue in an airborn trajectory while the larger droplets fall back onto the surface of the liquid.

Figure 3:
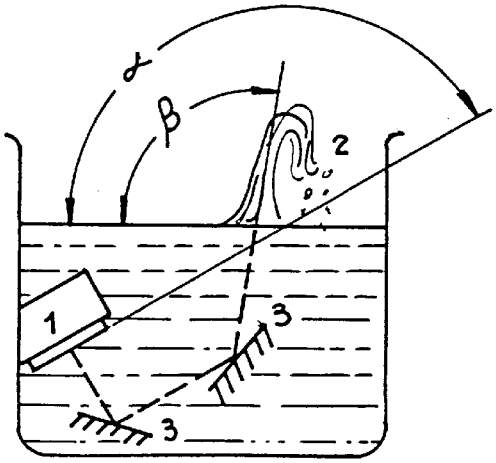
FIG. 3 illustrates a profile view of a device where the vibrating surface of the transducer is directing ultrasonic waves away from the liquid's surface.

FIG. 3 illustrates a profile view of a device where the vibrating surface of the transducer is directing ultrasonic waves away from the liquid's surface. Shown here is a device using the method for reducing the accumulation of precipatants and impurities on ultrasonic transducers according to the present invention.

An immersed ultrasonic transducer (1) in a liquid (4) is oriented with the vibrating surface of the transducer at an oblique angle α to the liquid surface. Two immersed acoustic mirrors (3) (3') are positioned and oriented opposite the vibrating surface such that the ultrasonic waves originating at the vibrating surface of the transducer are reflected by the acoustic mirrors and directed to the liquid surface at an approximately right angle β. This produces a spout shaped distribution containing a plurality of droplets (2) wherein the smaller droplets continue in an airborn trajectory and the larger droplets fall back onto the surface of the liquid.

We claim:

1. A method for reducing an accumulation of precipitants and impurities on a vibrating surface of an ultrasonic transducer, comprising the steps of:

(a) completely immersing the ultrasonic transducer in a liquid;

(b) orienting the vibrating surface of the transducer at an oblique angle to a surface of the liquid; and (c) placing and orienting at least one immersed acoustic mirror opposite said vibrating surface such that the ultrasonic waves originating at the vibrating surface of the transducer are reflected by said acoustic mirror and directed to the liquid surface at a predetermined angle.

2. A method according to claim 1 wherein the vibrating surface of the transducer is oriented downward to direct ultrasonic waves away from the liquid surface.

3. A method according to claim 1 wherein the vibrating surface of the transducer is oriented about perpendicular to the liquid surface.

4. A method according to claim 1 wherein the vibrating surface of the transducer is oriented skew to the liquid surface.

5. The method of claim 1 wherein said ultransonic transducer is used to atomize the liquid.

6. A method for reducing an accumulation of precipitants and impurities on a vibrating surface of an ultrasonic transducer, comprising the steps of:

(a) immersing the ultrasonic transducer in a liquid;

(b) orienting the vibrating surface of the transducer at an oblique angle to a surface of the liquid; and (c) placing and orienting at least one immersed acoustic mirror opposite said vibrating surface such that the ultrasonic waves originating at the vibrating surface of the transducer are reflected by said acoustic mirror and directed to the liquid surface at a predetermined angle.

* * * * *